US010060061B2

(12) United States Patent
Meiners et al.

(10) Patent No.: US 10,060,061 B2
(45) Date of Patent: Aug. 28, 2018

(54) BOBBINLESS SEWING MACHINE AND STITCH

(71) Applicant: Bargain Basement Fitness, LLC, Lehi, UT (US)

(72) Inventors: Jared Meiners, Lehi, UT (US); Brian Meiners, Sandy, UT (US)

(73) Assignee: Bargain Basement Fitness, LLC, Lehi, UT (US)

( * ) Notice: Subject to any disclaimer, the term of this patent is extended or adjusted under 35 U.S.C. 154(b) by 439 days.

(21) Appl. No.: 14/795,631

(22) Filed: Jul. 9, 2015

(65) Prior Publication Data

US 2017/0009388 A1 Jan. 12, 2017

(51) Int. Cl.

| | |
|---|---|
| ***D05B 57/22*** | (2006.01) |
| ***D05B 65/02*** | (2006.01) |
| ***D05B 1/12*** | (2006.01) |

(52) U.S. Cl.

CPC ..... *D05B 65/02* (2013.01); *D05B 1/12* (2013.01)

(58) Field of Classification Search

CPC ..... D05B 1/08; D05B 57/22; D05B 65/02; D05B 1/12

USPC ..... 112/156, 416, 22

See application file for complete search history.

(56) References Cited

U.S. PATENT DOCUMENTS

| | | | | |
|---|---|---|---|---|
| 245,667 | A | 8/1881 | Shearn | |
| 624,672 | A | 5/1899 | Orrell | |
| 655,571 | A | 8/1900 | McCarthy | |
| 684,587 | A | 10/1901 | Palmer | |
| 829,569 | A | 8/1906 | Caerden | |
| 857,941 | A | 6/1907 | Horton | |
| 1,284,911 | A | 12/1918 | Lautenschlager | |
| 1,652,946 | A | 12/1927 | Lautenschlager | |
| 1,971,143 | A | 8/1934 | Lautenschlager | |
| 2,696,794 | A * | 12/1954 | Kirsch | D05B 93/00 112/197 |
| 3,012,530 | A | 12/1961 | Ketterer | |
| 3,406,647 | A | 2/1967 | Rohrlick | |
| 3,429,275 | A | 2/1969 | Gorin | |
| 3,509,840 | A | 5/1970 | Rovin | |
| 4,169,422 | A * | 10/1979 | Hayes | D05B 1/06 112/201 |
| 4,708,070 | A | 11/1987 | Hiltner | |
| 4,879,960 | A | 11/1989 | Prais | |
| 5,881,663 | A | 3/1999 | Tsukioka | |
| 5,887,533 | A | 3/1999 | Tsukioka | |
| 6,263,813 | B1 * | 7/2001 | Toume | D05B 1/10 112/291 |

(Continued)

FOREIGN PATENT DOCUMENTS

| | | |
|---|---|---|
| CA | 2 643 604 | 5/2010 |

*Primary Examiner* — Danny Worrell

(74) *Attorney, Agent, or Firm* — Brinks Gilson & Lione; Ryan L. Marshall

(57) ABSTRACT

A system and methods for stitching are disclosed. The system includes a first thread feeding mechanism configured to feed a continuous supply of a first thread, a second thread feeding mechanism configured to feed a continuous supply of a second thread, a plate separating the first thread feeding mechanism and the second thread feeding mechanism, and a knot tying mechanism configured to pass a bight of the first thread for at least one turn around a portion of the second thread and securing the bight around the second thread.

18 Claims, 6 Drawing Sheets

(56) References Cited

U.S. PATENT DOCUMENTS

| | | | | |
|---|---|---|---|---|
| 9,200,396 | B2 * | 12/2015 | McCue | D05C 3/00 |
| 2014/0209234 | A1 | 7/2014 | McCue | |

* cited by examiner

BOBBINLESS SEWING MACHINE AND STITCH

BACKGROUND

1. Technical Field

The present disclosure relates to the field of sewing, and more particularly to apparatuses and methods for forming a stitch and the stitch itself.

2. Background Information

Sewing machines are commonly used to stitch one or more layers of fabric or material together for many applications. Sewing machines are also used to create patterns, shapes, and text on fabric. The two most common types of sewing machines either create a lock stitch with a bobbin and bobbin thread, or create a chain stitch with one or more feed threads on top or bottom.

A lock stitch sewing machine uses an upper spool of thread and a bobbin thread. The upper thread feeds through a needle that pushes through the fabric being sewn. The sewing machine then wraps the upper thread to secure the stitch. A limitation of a lock stitch sewing machine is that the bobbin must be small enough for the upper thread 1 to wrap around during the sewing process. If the bobbin is too large, it is difficult for the upper thread to wrap around the bobbin. Because the size of the bobbin is limited, the lower thread is limited in length and size in relation to the upper thread 1. While the upper thread 1 can be fed from a bulk source such as a large spool, the bobbin thread can only be as large as what will fit on the bobbin. Once the bobbin runs out of thread, the operator must stop the sewing machine and change the bobbin thread which leads to a loss of productivity and increased machine downtime. Additionally, because changing the bobbin and bobbin thread requires frequent user intervention, it is difficult to fully automate the sewing process.

A chain stitch overcomes the problems associated with a bobbin, since no bobbin is required. However, chain stitches have other drawbacks that limit their usefulness compared to the lock stitch. The primary problem with a chain stitch is the durability of the stitch. Because a chain stitch is often a single thread looping around itself, if one section of thread breaks in the stitch, the entire stitch may unravel.

Thus there exists a need for a sewing machine that is able to sew without the use of bobbin, like a chain stitch, but that forms a durable stitch, like a lock stitch.

BRIEF SUMMARY

In a first aspect, a sewing machine includes a first thread feeding mechanism, a second thread feeding mechanism, a plate, and a knot tying mechanism. The first thread feeding mechanism is configured to feed a continuous supply of a first thread. The second thread feeding mechanism is configured to feed a continuous supply of a second thread. The plate separates the first thread feeding mechanism and the second thread feeding mechanism and is configured to hold at least one layer of fabric. The knot tying mechanism is configured to pass a bight of the first thread for at least one turn around a portion of the second thread and secures the bight around the second thread.

In some embodiments, the sewing machine further includes a bight cutting mechanism configured to cut the bight open after the bight is secured around the second thread.

In some embodiments, the first thread feeding mechanism is further configured to pass the bight through the plate. In some embodiments, the first thread feeding mechanism comprises a needle having an eye.

In some embodiments, the knot tying mechanism is configured to knot the bight around the second thread in an overhand knot. In some embodiments, the knot tying mechanism is configured to knot the bight around the second thread in a figure-eight knot.

In some embodiments, the sewing machine further includes a third thread feeding mechanism and a looping mechanism configured to loop the first thread over the third thread feeding mechanism, wherein the sewing machine may selectively use either the second thread feeding mechanism and the knot tying mechanism, or the third thread feeding mechanism and the looping mechanism to stitch a fabric.

In another aspect a method of stitching at least one layer of fabric includes passing a bight of a first thread positioned on a first side of the at least one layer of fabric from the first side to a second side of the at least one layer of fabric opposite the first side, guiding the bight around a second thread positioned on the second side of the fabric for at least one turn, and knotting the bight with the second thread positioned in at least one turn of the bight.

In some embodiments, knotting the bight includes tying the bight in an overhand knot. In some embodiments, knotting the bight includes tying to the bight in a figure-eight knot.

In some embodiments, the method further includes trimming the bight near the second thread.

In some embodiments, a second fabric is positioned on the second side of the at least one layer of fabric and the bight is knotted between the second fabric and the second side of the at least one layer of fabric.

In some embodiments, the bight has a loop at an end of the bight extending from the knot, and the method further includes moving the at least one layer of fabric to a new location, passing a second bight of the first thread from the first side to a second side of the at least one layer of fabric at the new location and through the loop at the end of the bight extending from the knot, guiding the second bight around the second thread positioned on the second side of the fabric for at least one turn, and knotting the second bight with the second thread positioned in at least one turn of the second bight.

In another aspect, a knot-stitch for joining two or more fabrics includes a first thread positioned on a first side of the two or more fabrics, and a second thread positioned on a second side of the two or more fabrics opposite the first side. The second thread has a plurality of bights passing from the second side to the first second side and each bight of the plurality of bights has at least one turn about the first thread and is knotted to itself.

In some embodiments, each bight is knotted to itself through an overhand knot. In some embodiments, each bight is knotted to itself through a figure-eight knot. In some embodiments, each bight of the plurality of bights is trimmed near the first thread. In some embodiments, each bight is knotted to itself between a first fabric of the two or more fabrics and a second fabric of the two or more fabrics. In some embodiments, a bight of the plurality of bights passes through a loop formed by another bight from among the plurality of bights.

DETAILED DESCRIPTION

The described embodiments of the present disclosure will be best understood by reference to the drawings, wherein like reference numbers indicate identical or functionally similar elements. It will be readily understood that the components of the present disclosure, as generally described and illustrated in the figures herein, could be arranged and designed in a wide variety of different configurations. Thus, the following more detailed description, as represented in the figures, is not intended to limit the scope of the invention as claimed, but is representative of some embodiments disclosed herein.

Figure 1:
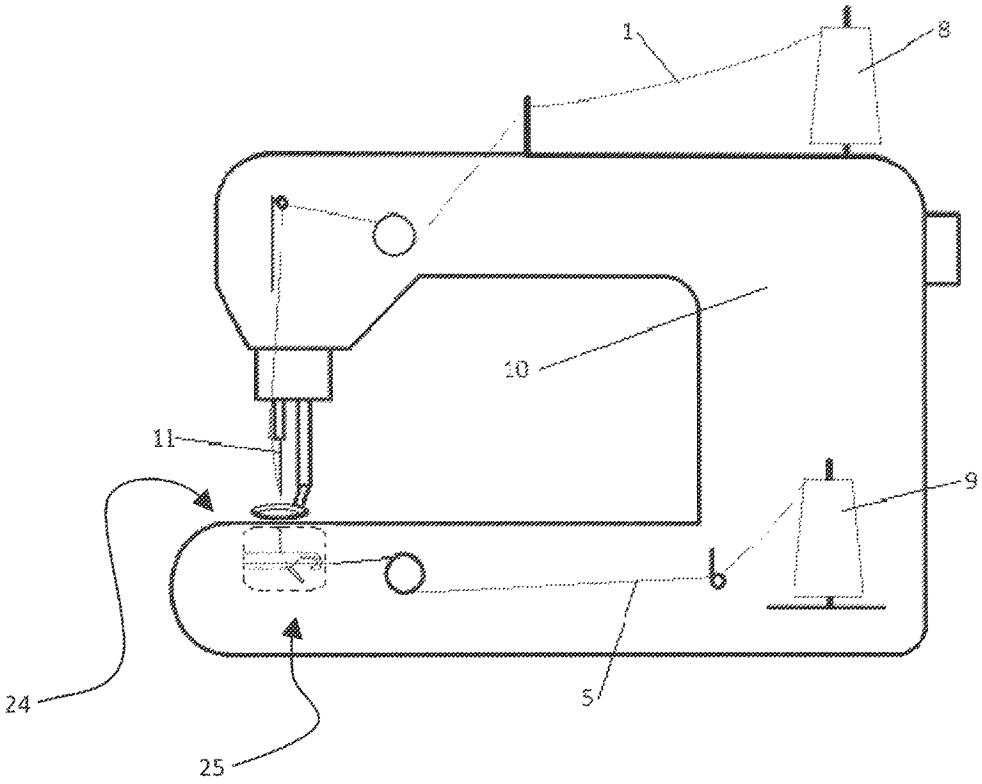
FIG. 1 illustrates a schematic of an embodiment of a sewing machine.

FIG. 1 illustrates an embodiment of a sewing machine 10 for sewing a knot-stitch. The sewing machine 10 includes a first thread feeding mechanism in the form of an upper spool 8 and a needle 11, a second thread feeding mechanism in the form of a lower spool 9. The upper spool feeds a continuous supply of a first thread to the needle 11, which is configured to reciprocate vertically, pulling the upper thread 1 when it travels downward. The lower spool 9 feeds a continuous supply of a second thread 5 to an area below the needle 11. A plate, in the form of a machine bed 24, supports the fabric being stitched, and the needle 11 passes through the fabric and an upper surface of the machine bed 24 during the downward stroke. The upper thread 1 passes through an eye (not shown) in the lower portion of the needle 11, such that when the needle 11 passes through the fabric, a bight (not shown) of the upper thread 1 passes through with it.

In some embodiments, sewing machine 10 may have a third thread feeding mechanism and looping mechanism positioned under the machine bed. The third thread feeding mechanism is a conventional bobbin and the looping mechanism is a wheel that passes the upper thread around the bobbin, in a conventional stitch. The third thread feeding mechanism is interchangeable with the second thread feeding mechanism, such that a user can selectively use either a conventional stitch, or the knot-stitch described herein.

The lower thread 5 is positioned below the machine bed 24 and is disposed perpendicular to the travel of the needle 11. As will be described in greater detail in relation to FIGS. 8-14, the sewing machine 10 is configured to tie the bight of the upper thread 1 around the lower thread 5 with the needle 11 in a downward position. When the needle 11 reciprocates upwards, it pulls the knot tight. The fabric then moves on the machine bed 24, and the needle 11 passes through the fabric again, pulling a new bight of the upper thread 1 with it. In the embodiment of FIG. 1, the sewing machine 10 ties the bight through the use of a knot tying mechanism 25 including a rotating latch hook, a loop hook, and grabber hook, all of which is shown in more detail in FIGS. 8-14. In operation, fabric to be stitched is placed on the machine bed 24 and the needle 11 passes through the fabric, carrying a bight of the upper thread 1 through the fabric with the needle 11. The knot tying mechanism 13 ties the bight around the lower thread 5 securing the bight to the lower thread 5. The needle 11 is retracted from the fabric and the fabric is moved slightly. The needle 11 passes back through the fabric and a new bight is tied around the lower thread 5 in the new location. This process is repeated for the length of the stitch.

The sewing machine 10 stitches one or more layers of material together. Common types of materials that may be sewn using the sewing machine 10 include, but are not limited to, fabric, batting, canvas, vinyl, leather, rubber, and upholstery. The embodiment may leave the knot on the top or bottom side of the layer or layers of material sewn or the knot may be between layers of material.

Figure 2:
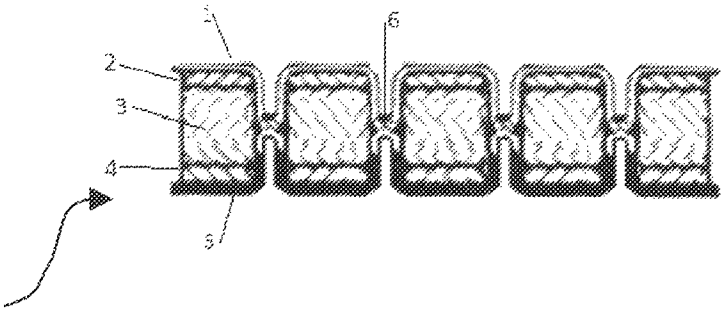
FIG. 2 illustrates a cross section of a quilt showing layers of fabric stitched together using an embodiment of a knot-stitch.

FIG. 2 illustrates an example of a three-layer quilt 20 having an embodiment of a knot-stitch joining its layers together. The quilt 20 has three layers of material including a top fabric 2, a batting material 3, and a bottom fabric 4. The three layers 2, 3, and 4 are stitched together with an upper thread 1 and a lower thread 5, and may be stitched with artistic patterns. Example artistic patterns may include any two dimensional shape, picture, or text. The upper thread 1 has a bight passing through the top fabric 2, the batting material 3, and the bottom fabric 4, and is secured to the lower thread 5 through a knot 6. The tension used for tying the knot 6 and the fabric type controls the placement of the knot 6. If the knot 6 is tied at a low tension, or with a more durable fabric, the knot 6 tends to be tied below the bottom fabric layer 4. However, if more tension is used when tying the knot 6, the knot 6 may be pulled through the bottom layer of fabric 4 as it is being tied, placing the knot 6 between the top fabric 2 and the lower fabric 4, as illustrated in FIG. 2. Additionally, the bight tied around the lower thread 5 may be cut in an area past the knot 6, as shown in FIG. 2. Cutting the bight after the knot 6 has been tied may prevent the loop of the bight from snagging.

Figure 3:
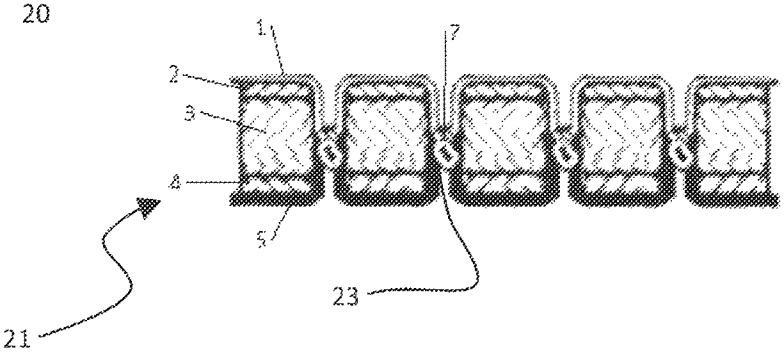
FIG. 3 illustrates a cross section of a quilt showing layers of a quilt stitched with an embodiment of a knot-stitch

Referring to FIG. 3, a cross section of an embodiment of a knot-stitch is illustrated with layers of a typical quilt 21, similar to FIG. 2, is illustrated. However, the bight of the upper thread 1 is not trimmed past the knot 7 like the knot-stitch of FIG. 2. Instead, after tying the bight around the lower thread 5, the remaining bight is left in a loop 23.

Figure 4:
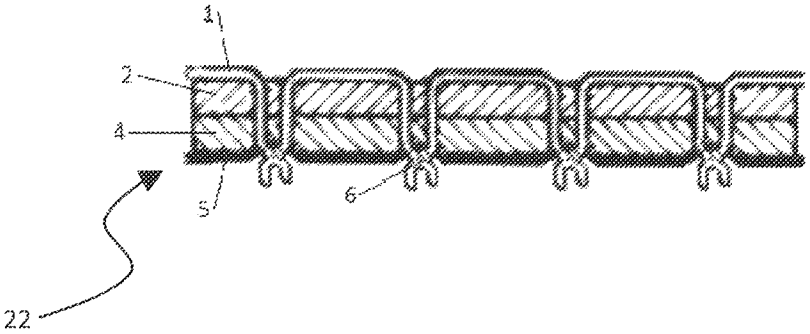
FIG. 4 illustrates a cross section of fabric layers stitched together with an embodiment of a knot-stitch.

FIG. 4 illustrates a cross section of an embodiment of a knot-stitch securing two layers of fabric 2, 4 to one another in a textile 22. The top fabric layer 2 and bottom fabric layer 4 are stitched together with upper thread 1 and lower thread 5. The upper thread 1 and lower thread 5 are held together with a knot 6 on the bottom side of the textile 22. In this embodiment, the knot 6 is left below the bottom fabric 4 and is not pulled through as in the previous embodiments. Additionally, this embodiment has the ends of the bight cut, similar to FIG. 2.

Figure 5:
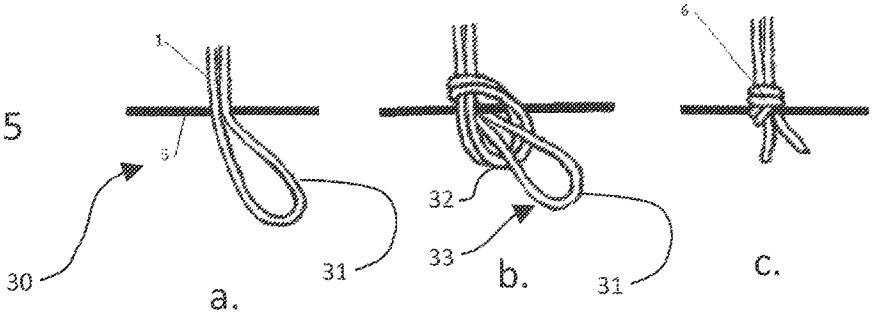
FIG. 5 illustrates a schematic of steps for tying a knot-stitch on a bight.

FIG. 5 illustrates an embodiment of a knot-stitch 30 with an upper thread 1 being secured to a lower thread 5 through a knot 6. In practice, the layers of fabric would typically be positioned above the knot-stitch as it is being tied, with the upper thread 1 passing through the layers of fabric and the lower thread 5 positioned below the fabric. The knot 6 may be an overhand knot tied in a conventional manner; however, a bight is used instead of a single thread. To tie the overhand knot, the bight 31 is formed into a bight-loop 32 and an end 33 of the bight 31 is passed through the bight loop 32 and pulled tight. The bight 31 is secured to the lower thread 5 by tying either passing the bight end 33 around the lower thread 5 before passing it through the bight-loop 32 as shown in FIG. 5, or by forming the bight-loop around the lower thread 5 as shown in FIG. 6.

In FIG. 5*a*, a bight 31 of the upper thread 1 is passed below the lower thread 5. In FIG. 5*b*, the bight 31 is formed into a bight-loop 32 with the top of the bight-loop 32 passing over the lower thread 5. An end 33 of the bight 31 above the lower thread 5 is then passed over the upper thread 1 and around the lower thread 5, and through a bight loop 32 below the lower thread 5. The end of the bight 31 is pulled tight, tightening the knot and securing the upper thread 1 to the lower thread 5. One example of a mechanism for tying the knot is shown in FIGS. 8-14, which will be described in greater detail to follow. FIG. 5*c*, illustrates the end of the bight 31 being cut, preventing the end 33 of the bight 31 from snagging on other items.

Figure 6:
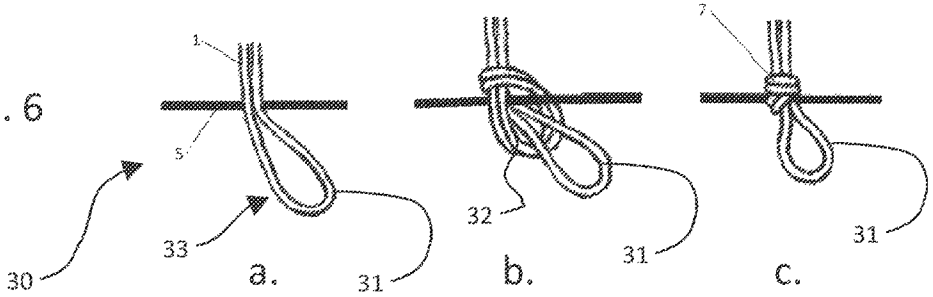
FIG. 6 illustrates a schematic of alternate steps for tying a knot-stitch on a bight.

FIG. 6 illustrates another embodiment of a knot-stitch 30 similar to the knot-stitch of FIG. 5, but with the bight-loop 32 being formed around the lower thread 5. In FIG. 6*a* the end 33 of the bight 31 of the upper thread 1 is passed below the lower thread 5. In FIG. 6 *b*, the bight 31 is formed into a bight loop 32 around the lower thread 5 with the end 33 of the bight loop passing over the upper thread 1 above the lower thread 5 and back around the lower thread 5 and through the bight loop 32. The knot 7 is pulled tight, securing the bight 31 to the lower thread 5. As with the stitch of FIG. 5, depending on the tension used to pull the knot 7 tight, the knot 7 may pull through a layer of fabric to end up between the fabric layers, or it may remain below the fabric layers.

Figure 7:
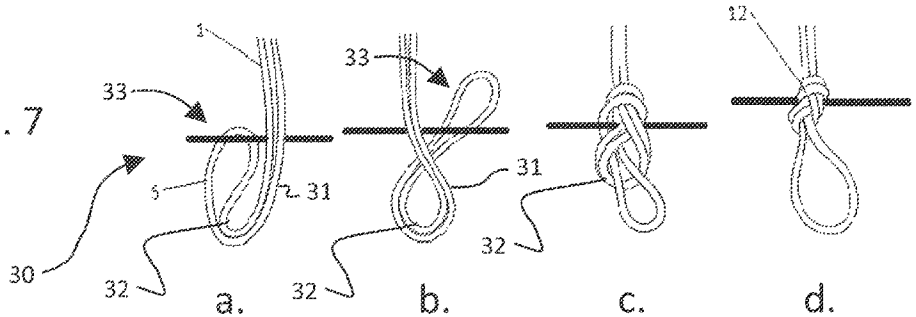
FIG. 7 illustrates a schematic of steps for tying a knot-stitch in a figure-eight knot on a bight.

FIG. 7 illustrates another embodiment of a knot-stitch 30, but using a figure-eight knot 12 in place of the overhand knot of FIGS. 5 and 6. The figure-eight knot 12 is tied in a conventional manner, but using a bight 31 in place of a single thread. The figure-eight knot 12 is tied with the bight 31 making at least one turn around the lower thread 5, either while forming a bight-loop 32 or when passing an end 33 of the bight 31 through a bight loop 32. In FIG. 7*a*, an end 33 of the bight 31 is formed into a bight loop 32 below the lower thread 5. In FIG. 7*b*, the end 33 of the bight 31 is passed behind the upper thread 1 and above and behind the lower thread 5. In FIG. 7*c*, the end 33 of the bight 31 is passed over in front of the upper thread 1, behind the lower thread 5, and through the bight loop 32 below the lower thread 5. In FIG. 7*d*, the knot 12 is pulled tight, securing the upper thread 1 to the lower thread 5.

It will be noted that the knots of FIGS. 5 through 7 are exemplary and that embodiments are not limited to these particular knots. Furthermore, as shown in FIGS. 5 and 6, the same knot may have different configurations for tying the upper thread 1 to the lower thread 5, so long as the bight 31 is secured in a knot with at least one turn wrapping around the lower thread 5.

FIGS. 8-14 illustrate a schematic of a knot tying mechanism 13 configured to tie the knot-stitches shown previously. The knot tying mechanism 13 is implemented by the sewing machine of FIG. 1. The knot tying mechanism 25 is positioned below the machine bed 12 of the sewing machine 10 and is below the fabric when sewing. The needle 11 is driven in a reciprocating up and down motion as is typical for a sewing machine 10. The knot tying mechanism 25 is positioned alongside the lower thread 5 and includes a shaft 13, a grabbing hook 14, a latch 15, a hook end 16, and a looper 17. The shaft 13 reciprocates horizontally, while oscillating about a horizontal axis. The grabbing hook 14, latch 15, and hook end 16 are each attached to the shaft, while the looper 17 is independent of the shaft 13. Each of these components will be described in further detail in the description of the figures that follows.

Figure 8:
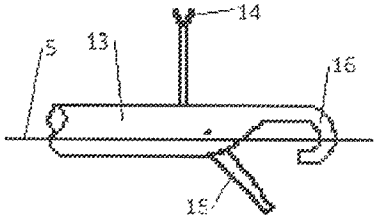
FIG. 8 illustrates and embodiment of a knot tying mechanism configured to tie a knot-stitch.
Figure 9:
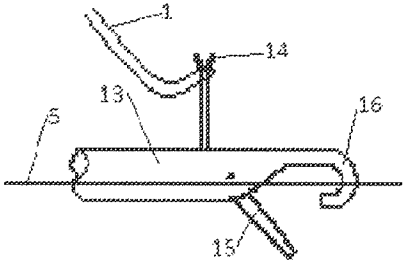
FIG. 9 illustrates the a knot tying mechanism of FIG. 7 with a upper thread
Figure 10:
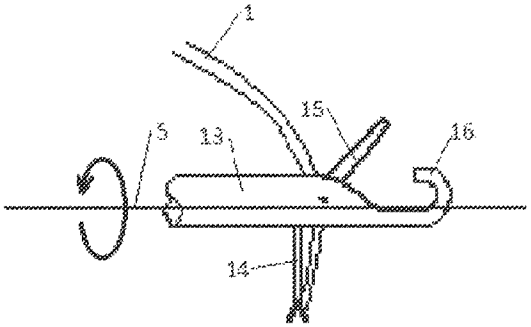
FIG. 10 illustrates the knot tying mechanism of FIG. 8 with the upper thread below the assembly.
Figure 11:
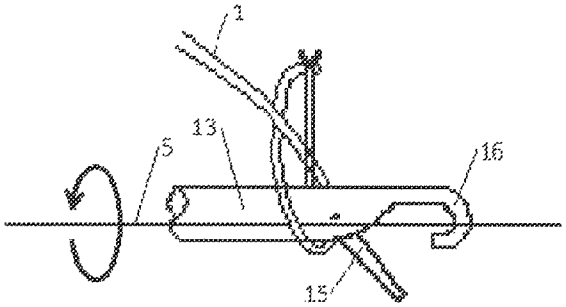
FIG. 11 illustrates the knot-stitch tying assembly of FIG. 8 with the upper thread being wrapped around the assembly.

FIG. 8 illustrates the shaft 13 of the knot tying mechanism 25 alongside the lower thread 5, with the latch 15 at a lower position, and the grabbing hook 14 in an upright position. In this orientation, the needle (not shown in these FIGS.) pierces the fabric layers and moves a bight of the upper thread 1 near the grabbing hook 14, as shown in FIG. 9. With the upper thread 1 near the grabbing hook 14, the shaft 13 rotates causing an end of the grabbing hook 14 to engage the bight of the upper thread 1 and pull it around the shaft 13, from the position shown in FIG. 9, to the position shown in FIG. 10, with the grabbing hook 14 extending downward and the bight passing behind the shaft 13. Further rotation of the shaft 13 causes the grabbing hook 14, still with the bight on its tip, to rotate back into the position of FIG. 9, wrapping the bight around the shaft 13 as shown in FIG. 11.

Figure 12:
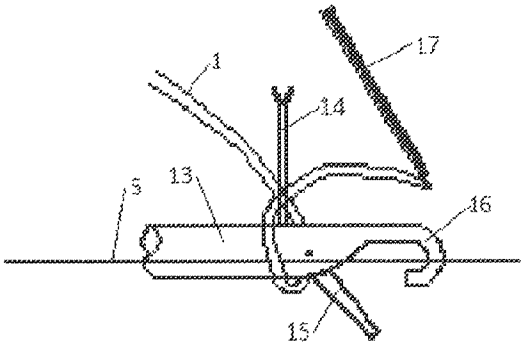
FIG. 12 illustrates the knot-stitch tying assembly of FIG. 8 with the upper thread being moved off of a grabber hook by a looper.
Figure 13:
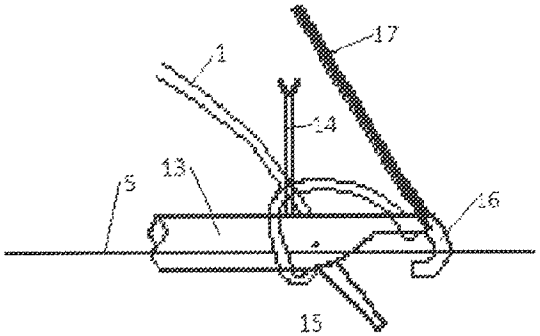
FIG. 13 illustrates the knot-stitch tying assembly of FIG. 8 with the upper thread being position in the hook end.
Figure 14:
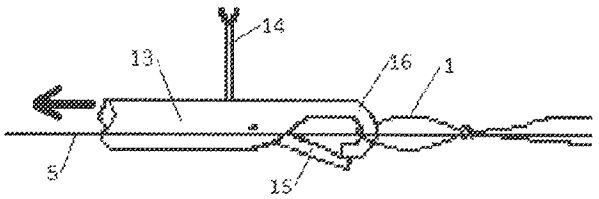
FIG. 14 illustrates the knot-stitch tying assembly of FIG. 8 with the hook end being retracted, tying the knot-stitch about the lower thread.
Figure 15:
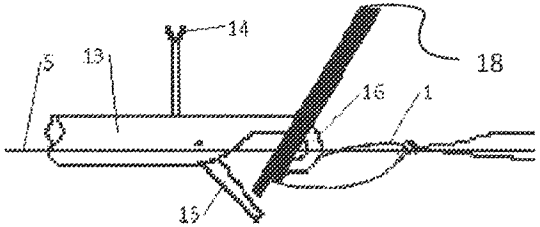
FIG. 15 illustrates the knot-stitch assembly of FIG. 8, with a notched clearing rod configured to remove the bight from the hook end.

In FIG. 12, the looper 17 grabs the upper thread 1 and pulls it forward off of the grabber hook 14 and down to the hook end 16, wrapping around the upper portion of the upper thread 1 in the process. In FIG. 13, the looper 17 extends past the hook end 16 until the bight of the upper thread 1 loops over the hook end 16. The shaft 13 is then moved to the left in FIG. 14, pulling the bight through the loop of the bight. Because the lower thread 5 was alongside the shaft 13 as the bight of the upper thread 1 was looped around the shaft 13, the lower thread 5 is secured in the knot of the upper thread 1. The hook end 16 may have a cutting blade on its interior, such that when pulling the bight of the upper thread 1 through the loop, it will cut the bight of the upper thread 1 when it reaches a predetermined level of tension. In some embodiments, such as that shown in FIG. 15, a notched release rod 18 engages the bight loop and moves it over the hook end, releasing the bight from the knot-stitch tying assembly.

Figure 16:
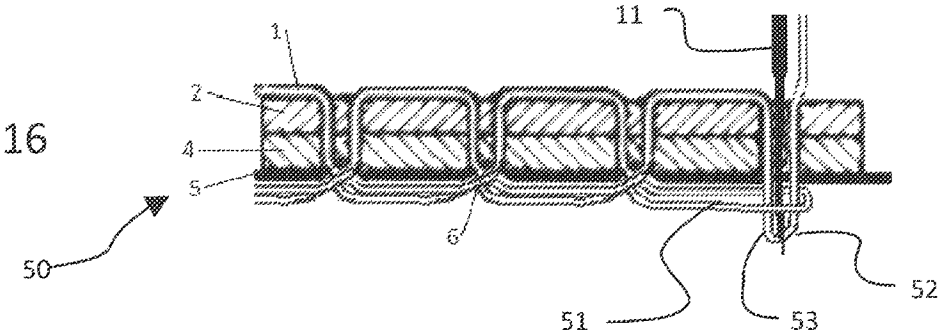
FIG. 16 illustrates an alternative locking knot-stitch.

In FIG. 16, an alternative embodiment of a knot-stitch 50 is shown. In this embodiment, each bight is left untrimmed by the hook end and left as a loop 51. In a subsequent stitch 52, the needle 11 passes another bight 53 of the upper thread 1 through the loop 51 before tying the subsequent stitch 52, which will also leave an untrimmed bight with a loop. The process repeats with a following stitch passing through the loop of the subsequent stitch 52, such that each stitch is tied with a bight from the upper thread passing through a looped end of a previous stitch. This forms a locking stitch that is resistant to unraveling if a thread should fail.

While various embodiments have been described above, it should be understood that they have been presented by way of example only, and not limitation. The described system and method for tying a knot-stitch is not limited to the specific form described herein. For example, while the description makes use of the terms upper, lower, top, and bottom, these are each relative terms used in the description of the drawings. One of ordinary skill in the art would recognize that it may be possible to reposition the sewing machine such that the plate was at an angle, or that the knot was tied on a different side of the fabric. It will be apparent to persons skilled in the relevant arts that various changes in form and details can be made therein without departing from the spirit and scope of the invention. Thus, the breadth and scope of the present invention should not be limited by any of the above-described exemplary embodiments, but should be defined only in accordance with the following claims and their equivalents.

The invention claimed is:

1. A sewing machine comprising:

a first thread feeding mechanism configured to feed a continuous supply of a first thread;

a second thread feeding mechanism configured to feed a continuous supply of a second thread;

a plate separating the first thread feeding mechanism and the second thread feeding mechanism, the plate configured to hold at least one layer of fabric; and a knot tying mechanism configured to pass a bight of the first thread for at least one turn around a portion of the second thread and securing the bight around the second thread, and wherein the first thread feeding mechanism is further configured to pass the bight through the plate.

2. The sewing machine of claim 1, further comprising:

a bight cutting mechanism configured to cut the bight open after the bight is secured around the second thread.

3. The sewing machine of claim 1, wherein the knot tying mechanism is configured to knot the bight around the second thread in an overhand knot.

4. The sewing machine of claim 1, wherein the knot tying mechanism is configured to knot the bight around the second thread in a figure-eight knot.

5. The sewing machine of claim 3, wherein the first thread feeding mechanism comprises a needle having an eye.

6. The sewing machine of claim 1, further comprising a third thread feeding mechanism and a looping mechanism configured to loop the first thread over the third thread feeding mechanism, wherein the sewing machine may selectively use either the second thread feeding mechanism and the knot tying mechanism, or the third thread feeding mechanism and the looping mechanism to stitch a fabric.

7. A method of stitching at least one layer of fabric, comprising:

passing a bight of a first thread positioned on a first side of the at least one layer of fabric from the first side to a second side of the at least one layer of fabric opposite the first side;

guiding the bight around a second thread positioned on the second side of the fabric for at least one turn; and knotting the bight with the second thread positioned in at least one turn of the bight.

8. The method of claim 7, wherein knotting the bight comprises tying the bight in an overhand knot.

9. The method of claim 8, wherein knotting the bight comprises tying to the bight in a figure-eight knot.

10. The method of claim 7, further comprising trimming the bight near the second thread.

11. The method of claim 7, wherein a second fabric is positioned on the second side of the at least one layer of fabric and wherein the bight is knotted between the second fabric and the second side of the at least one layer of fabric.

12. The method of claim 7, wherein the bight has a loop at an end of the bight extending from the knot and the method further comprises:

moving the at least one layer of fabric to a new location;

passing a second bight of the first thread from the first side to the second side of the at least one layer of fabric at the new location and through the loop at the end of the bight extending from the knot;

guiding the second bight around the second thread positioned on the second side of the fabric for at least one turn; and knotting the second bight with the second thread positioned in at least one turn of the second bight.

13. A knot-stitch for joining two or more fabrics, comprising:

a first thread positioned on a first side of the two or more fabrics;

a second thread positioned on a second side of the two or more fabrics opposite the first side, the second thread having a plurality of bights passing from the second side to the first side, with each bight of the plurality of bights having at least one turn about the first thread and being knotted to itself.

14. The knot-stitch of claim 13, wherein each bight is knotted to itself through an overhand knot.

15. The knot-stitch of claim 13, wherein each bight is knotted to itself through a figure-eight knot.

16. The knot-stitch of claim 13, wherein each bight of the plurality of bights is trimmed near the first thread.

17. The knot-stitch of claim 13, wherein each bight is knotted to itself between a first fabric of the two or more fabrics and a second fabric of the two or more fabrics.

18. The knot-stitch of claim 13, wherein a bight of the plurality of bights passes through a loop formed by another bight from among the plurality of bights.

* * * * *